US010588817B2

(12) United States Patent
Dorsey

(10) Patent No.: US 10,588,817 B2
(45) Date of Patent: Mar. 17, 2020

(54) VACUUM-DRIVEN PERSONAL DEVICE

(71) Applicant: Kevin Joseph Dorsey, Fitchburg, WI (US)

(72) Inventor: Kevin Joseph Dorsey, Fitchburg, WI (US)

( * ) Notice: Subject to any disclaimer, the term of this patent is extended or adjusted under 35 U.S.C. 154(b) by 1072 days.

(21) Appl. No.: 15/041,726

(22) Filed: Feb. 11, 2016

(65) Prior Publication Data

US 2017/0231864 A1 Aug. 17, 2017

(51) Int. Cl.
*A61H 19/00* (2006.01)
*A61H 9/00* (2006.01)

(52) U.S. Cl.
CPC ..... *A61H 19/32* (2013.01); *A61H 9/0057* (2013.01); *A61H 9/0071* (2013.01); *A61H 2201/0107* (2013.01); *A61H 2201/0192* (2013.01); *A61H 2201/1238* (2013.01); *A61H 2201/1635* (2013.01)

(58) Field of Classification Search
CPC ..... A61H 19/00; A61H 19/30; A61H 19/32; A61H 9/005; A61H 9/0057; A61H 2205/087; A61F 5/41
See application file for complete search history.

(56) References Cited

U.S. PATENT DOCUMENTS 2,597,966 A * 5/1952 Adler ..... A61H 9/005 15/415.1
4,175,554 A * 11/1979 Gerow ..... A61F 5/41 600/38
4,378,008 A * 3/1983 Osbon, Sr. ..... A61F 5/41 600/38
4,641,638 A * 2/1987 Perry ..... A61F 5/41 600/39
4,856,498 A * 8/1989 Osbon ..... A61F 5/41 600/38
5,094,230 A * 3/1992 Clark, Jr. ..... A61F 5/41 600/38
5,234,401 A * 8/1993 Yamanaka ..... A61F 5/41 600/38
5,244,453 A * 9/1993 Osbon ..... A61F 5/41 600/38
5,421,808 A * 6/1995 Osbon ..... A61F 5/41 600/38
5,624,378 A * 4/1997 Baldecchi ..... A61F 5/41 600/38

(Continued)

*Primary Examiner* — Michael J Tsai
(74) *Attorney, Agent, or Firm* — Craig Fieschko; DeWitt LLP

(57) ABSTRACT

A vacuum-driven adapter for sexual stimulation includes a primary conduit extending from a base to a crown. The crown is tapered such that when it is inserted into a hose of a running vacuum, it is partially sucked into the vacuum hose to secure the conduit to the hose via a suction fit. At the base is an opening sized to longitudinally receive a male member therethrough. Air flowing into the primary conduit on its way to the vacuum hose vibrates the male member like a reed of a wind instrument. An aperture near the crown is plugged by the user to maintain suction during use; unplugging the aperture may break the seal of the suction fit. Tuning apertures direct air to the male member and can be plugged and unplugged to manipulate air flow and stimulation. Secondary and tertiary conduits nest in the primary conduit to provide sizing options.

18 Claims, 3 Drawing Sheets

(56) References Cited

U.S. PATENT DOCUMENTS

| | | | | |
|---|---|---|---|---|
| 5,964,965 | A * | 10/1999 | Schulz | C01B 3/0031 148/400 |
| 6,183,414 | B1 * | 2/2001 | Wysor | A61B 5/14551 600/38 |
| 6,248,059 | B1 * | 6/2001 | Gamper | A61F 5/41 600/38 |
| 7,037,256 | B2 * | 5/2006 | Osbon | A61F 5/41 600/38 |
| 2013/0226054 | A1 * | 8/2013 | Smith | A61F 5/41 601/154 |
| 2016/0317380 | A1 * | 11/2016 | Gutierrez Villanueva | A61H 19/44 |

* cited by examiner

VACUUM-DRIVEN PERSONAL DEVICE

FIELD OF THE INVENTION

This document concerns an invention relating generally to devices that facilitate sexual pleasure, and in particular, to sex toys that use air flow to stimulate the male sexual organ.

BACKGROUND OF THE INVENTION

Sexual stimulation is highly personal, making it very difficult to make a device that suits every user. Individuals vary in what motions, pressures, speeds, etc. are deemed sexually pleasurable. Devices that allow the user to tailor the sexual experience by varying the sensations experienced, and that are cost-effective, are desirable.

SUMMARY OF THE INVENTION

The invention, which is defined by the claims set forth at the end of this document, is directed to "sex toys" that at least partially alleviate the aforementioned problems. A basic understanding of some of the features of preferred versions of the invention can be attained from a review of the following brief summary of the invention, with more details being provided elsewhere in this document. To assist in the reader's understanding, the following review makes reference to the accompanying drawings (which are briefly reviewed in the "Brief Description of the Drawings" section following this Summary section of this document).

Referring initially to FIGS. 1A, 2, and 4, An exemplary vacuum-driven personal adapter 10 for male sexual stimulation includes an elongated primary conduit 100 that extends longitudinally from an insertion end (or base) 105 to a coupling end 110. At the coupling end 110 is a crown 115 that serves as a vacuum-hose interface for attaching the adapter 10 to a vacuum device. The crown 115 may be tapered so that when the crown 115 is inserted into a vacuum hose of a running vacuum, the crown 115 is partially sucked into the vacuum hose to secure the primary conduit 100 to the vacuum hose via a suction fit. The insertion end 105 includes a member opening 120 sized to longitudinally receive a penis therethrough. When the crown 115 is inserted into a vacuum hose and a vacuum is turned on to generate negative pressure in the vacuum hose, the vacuum hose attaches to the outside edge of the crown 115 due to suction. The user may then insert a penis into the primary conduit 100. Air flowing into the primary conduit 100 on its way to the vacuum hose vibrates the penis like a reed of a musical instrument; specifically, the reed of a wind instrument. The penis vibrates from being in the adapter 10, without thrusting or other longitudinal motion of the penis into or out of the adapter 10.

Further advantages and features of the invention will be apparent from the remainder of this document in conjunction with the associated drawings.

DETAILED DESCRIPTION OF PREFERRED VERSIONS OF THE INVENTION

Figure 4:
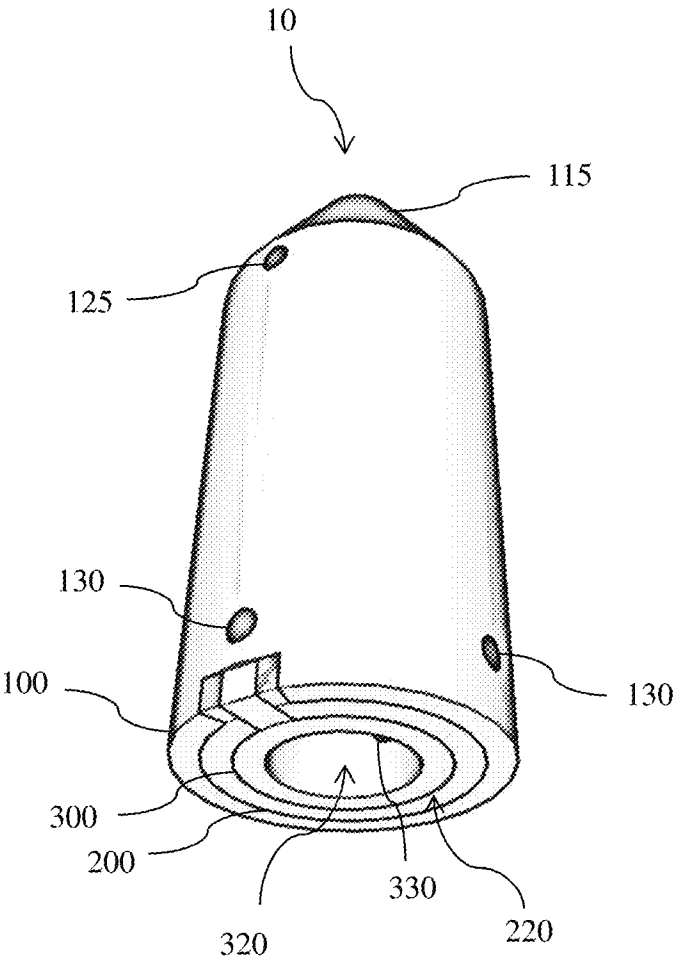
FIG. 4 shows the nested conduits 100, 200, and 300 when assembled and aligned.

Returning to FIGS. 1A, 2, and 4, the primary conduit 100 preferably includes a coupling end aperture 125 through which air can enter the primary conduit 100. The coupling end aperture 125 allows the user to throttle the negative pressure within the primary conduit 100 by obstructing the coupling end aperture 125 to varying degrees such that the amount of suction in the primary conduit 100 varies from a minimal suction level (when air flow through the coupling end aperture 125 is unobstructed) to a maximum suction level (when the coupling end aperture 125 is sealed off against air flow therethrough). The coupling end aperture 125 preferably serves as a safety release valve such that, for the user to experience full suction, the coupling end aperture 125 would have to remain covered by a user; otherwise, the suction decreases to a point that the primary conduit 100 detaches from the vacuum hose relatively easily. That is, the adapter 10 would disengage unless the coupling end aperture 125 continues to be obstructed (presumably, by the user's hands and fingers). Because the primary conduit 100 preferably attaches to a vacuum hose via a suction fit rather than a friction fit (or other attachment means that can be maintained without suction), if suction is removed, the adapter 10 separates ("falls away") from the vacuum hose. Consequently, "letting go" of the coupling end aperture 125 can break the suction and deactivate the suction experienced by the penis.

Figures 1A, 1B, 1C:
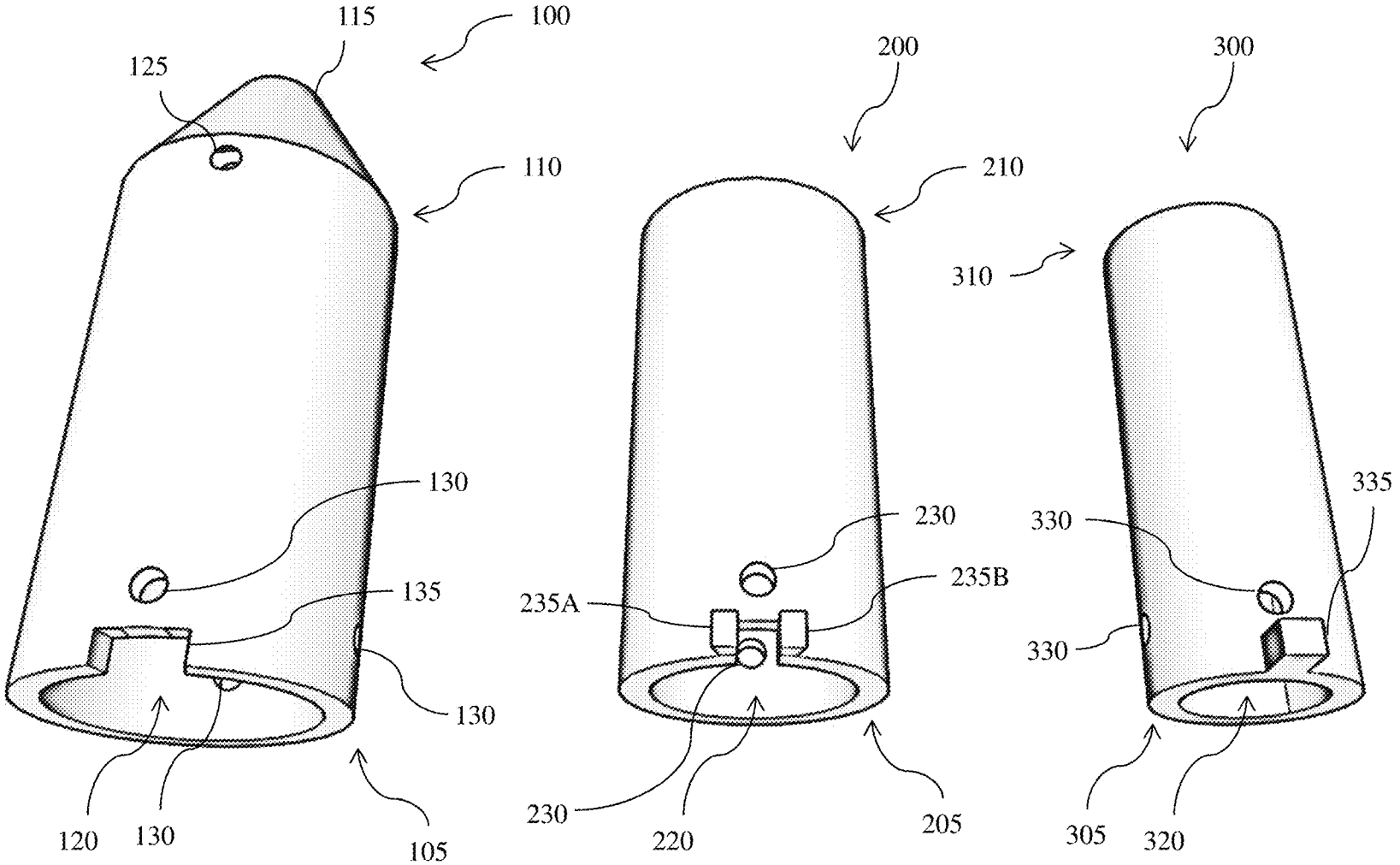
FIGS. 1A, 1B, and 1C are perspective views of an exemplary primary conduit 100, an exemplary secondary conduit 200, and an exemplary tertiary conduit 300, respectively.
Figure 2:
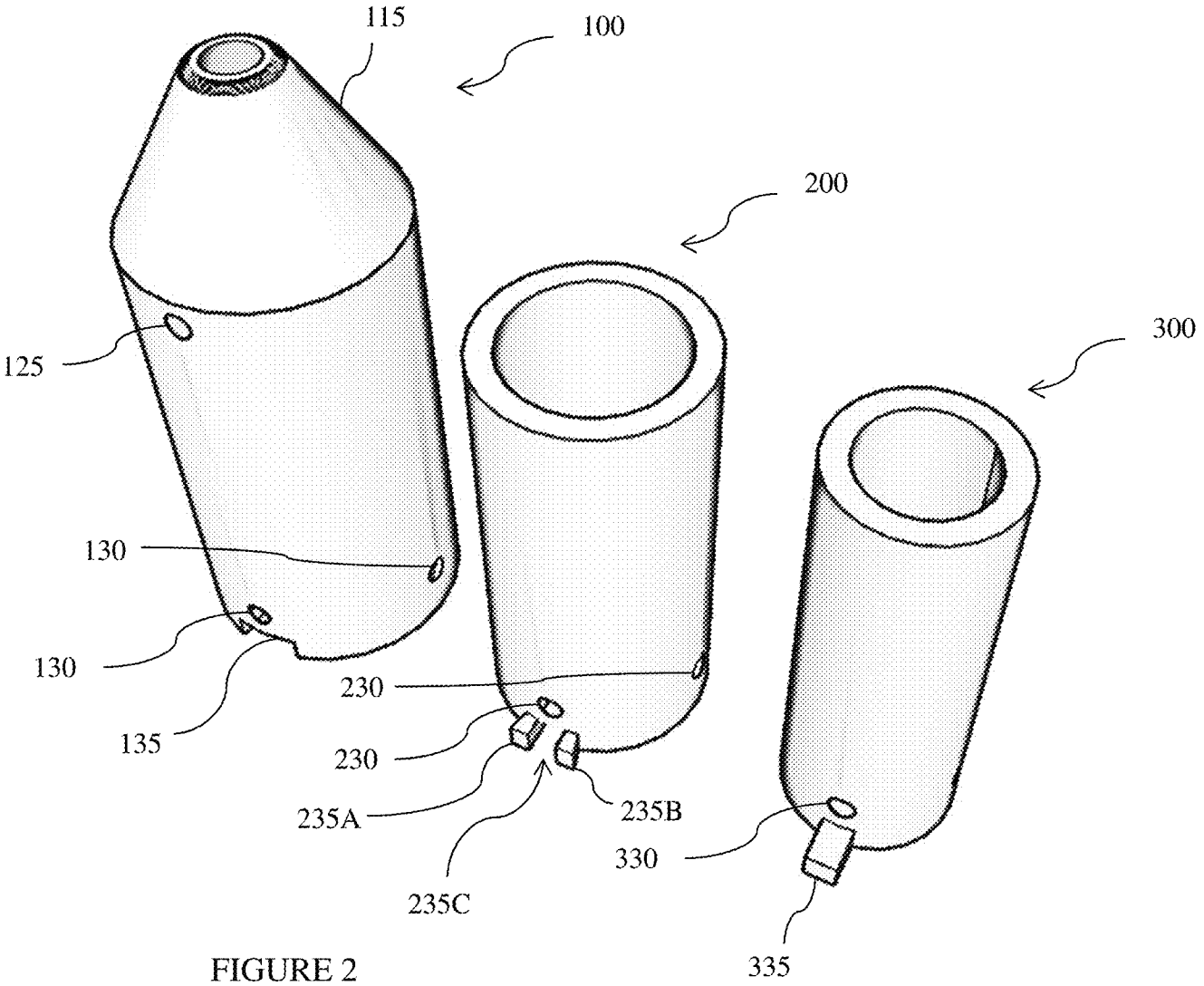
FIG. 2 is an alternative view of the exemplary conduits 100, 200, 300 of FIGS. 1A-1C shown side-by-side.
Figure 3:
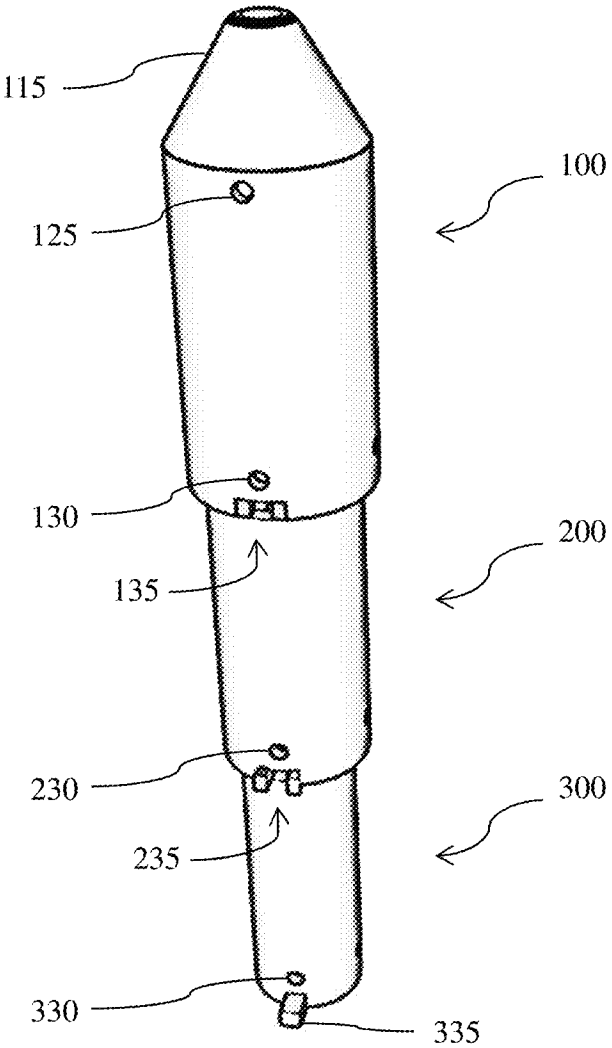
FIG. 3 shows the three conduits 100, 200, 300 of FIG. 2 in the process of being assembled, with the tertiary conduit 300 partly inserted into the secondary conduit 200, which is partially inserted into the primary conduit 100.

Referring also to FIGS. 1B, 1C, and 3, in addition to the primary conduit 100, the adapter 10 may include one or more additional "nesting" conduits that fit in each other to reduce a diameter of the member opening 120. The additional conduits provide sizing options so that the adapter 10 can be customizable for different users. The primary conduit 100 (from which the crown 115 or other vacuum-hose interface extends) is the largest, with a length of (for example) nine inches (not including the crown 115). A secondary conduit 200 has a complementary shape that allows it to snugly fit in the primary conduit 100, and a tertiary conduit 300 has a complementary shape that allows it to snugly fit in the secondary conduit 200. The secondary and tertiary conduits 200, 300 may be (for example) eight inches long, leaving them short of being able to block the coupling end aperture 125 (discussed below) of the primary conduit 100 when the conduits 100, 200, 300 are nested (see FIG. 4).

A set of primary tuning apertures 130 are preferably placed about the primary conduit 100 to allow for variation in air flow as different apertures 130 are obstructed to different degrees by the user. By plugging or partially obstructing the tuning apertures 130, the user is able to change the airflow rate over different regions of the penis (in a sense, to "tune" the adapter 10). The tuning apertures 130 can play a role in throttling the suction, and they are particularly useful for directing the air to different parts of the inside of the primary conduit 100. They are also particularly useful for adjusting where air is able to enter the adapter 10. Air that enters the adapter 10 though the member opening 120 moves past the groin/pelvic region, and the sensation of that moving air can be distracting. The tuning apertures 130 move the air flow away from the user's pelvic region, focusing the air (and the sensations being experienced) on the penis rather than on the stomach or groin areas. The set of tuning apertures 130 of the versions depicted in the drawings include four tuning apertures 130 at base 105 of the conduits 100 (that is, near the insertion end 105) that are equally-spaced circumferentially. This can effectively segment the air flow into four quadrants. Positioning the tuning apertures 130 relatively closer to the member opening 120 allows the air to flow past a greater proportion of the penis inserted in the conduit 100.

The secondary and tertiary conduits 200, 300 also include tuning apertures 230, 330 which preferably can be aligned with the tuning apertures 130 of the primary conduit 100 to facilitate air flow. The conduits 100, 200, 300 may be "keyed" to each other to facilitate alignment of the tuning apertures 130, 230, 330. For example, the primary conduit 100 may include a primary indentation 135 at its member opening 120, and the secondary conduit 200 may include a secondary alignment protrusion 235 sized and shaped to be complementarily received in the primary indentation 135. When the secondary conduit 200 is inserted into the primary conduit 100, the secondary alignment protrusion 235 is received in the primary indentation 135 to rotationally align the primary and secondary conduits 100, 200 such that the secondary tuning apertures 230 overlap with the primary tuning apertures 130. The secondary alignment protrusion 235 can also longitudinally align the primary and secondary conduits 100, 200 by restricting the secondary conduit 200 from entering the primary conduit 100 beyond a point at which their ends are flush with each other (see FIG. 4).

The secondary alignment protrusion 235 can include a pair of secondary prongs 235A, 235B separated by a secondary gap 235C, the pair of secondary prongs 235A, 235B being sized and shaped to be received in the primary indentation 135. The tertiary conduit 300 includes a tertiary alignment protrusion 335 in the form of a tertiary prong that is sized and shaped to be complementarily received in the secondary gap 235C. Such a combination of primary indentation 135, secondary alignment protrusion 235, and tertiary alignment protrusion 335 allow the tertiary tuning apertures 330 to overlap with the secondary tuning apertures 230, and the secondary tuning apertures 230 to overlap with the primary tuning apertures 130, when the secondary and tertiary conduits 200, 300 are nested in the primary conduit 100. The tertiary alignment protrusion 335 similarly can also longitudinally align the primary, secondary, and tertiary conduits 100, 200, 300 by restricting the tertiary conduit 300 from entering the primary conduit 100 and the secondary conduit 200 beyond a point at which their ends are flush with each other (see FIG. 4).

To use the exemplary adapter 10, a user may begin by taking the primary conduit 100 and nesting therein the secondary and tertiary conduits 200, 300 as desired. The crown 115 of the primary conduit 100 can then be inserted into a standard hose of a vacuum cleaner or other vacuum device and the vacuum device turned on or otherwise activated. The negative pressure generated in the hose by the vacuum device sucks the crown 115 into the hose, until the crown 115 can no longer enter the hose. The crown's 115 tapered shape allows it to fit into hoses of varying diameters, as long as the opening of the vacuum hose does not have a larger diameter than the widest part of the crown 115 (which, in the version depicted in the drawings, is also the diameter of the cylindrical primary conduit 100 at the primary coupling end 110). That is, a generally circular cross-section of the crown 115 complementarily engages a circular cross-section of a generally cylindrical vacuum hose when the crown 115 is sealed with the vacuum hose via a suction fit. The crown 115 may have a generally conical shape with a diameter range that would allow it to interface with most standard hose sizes.

The air flow vibrates the penis like a reed, without vibration of the conduits 100, 200, 300 themselves. The adapter 10 is similar to a duck call or kazoo: the adapter 10 does not move but the penis (or "reed") oscillates very rapidly inside the conduits 100, 200, 300. No manual action or particular movement is required of the user. The inside of the conduits 100, 200, 300 do not require contours and need not be adorned, as the penis is not stimulated primarily by direct pressure against the conduits 100, 200, 300 but rather by air flow between the penis and the conduits 100, 200, 300. The faces of the adapter 10 that touch the user can thus be smooth. Hard, non-porous, and smooth surfaces make the adapter 10 easier to clean and can be more comfortable. Rigid edges (as opposed to soft or foam edges) that are rounded could be provided for the user's comfort. The adapter 10, and in particular conduits 100, 200, 300, could be made of clear acrylic material to allow the user to see through the device, something that may have user appeal.

Various preferred versions of the invention are shown and described above to illustrate different possible features of the invention and the varying ways in which these features may be combined. Apart from combining the different features of the foregoing versions in varying ways, other modifications are also considered to be within the scope of the invention. Following is an exemplary list of such modifications.

First, although exemplary devices are discussed as an adapter that interfaces with a hose of a vacuum cleaner (or other device capable of generating negative pressure), alternative versions may (for example) have an integrated negative-pressure device.

Second, although in the above discussion the apertures are obstructed using one's hand or other body part, a mechanical means (automated or manual) can also be provided for facilitating control of the airflow. For example, removable or adjustable plugs, seals, sliding "doors," coverings (such as bands, sleeves, and removable tapes), etc. could be provided to assist the user in adjusting or maintaining air flow without having to move (or keep stationary) fingers or hands.

Third, the precise shapes, sizes, locations, etc. of apertures and the conduits as a whole could be modified to achieve other desirable configurations. Such changes could be made to (for example) achieve different air flows, allow the user to stimulate different portions of the conduits, to modify the ways that the user could manipulate air flow, etc. For example, the tuning apertures 130 could be positioned in a straight line or helically along the length of the conduits.

Fourth, although the walls of the conduits are shown to be cylindrical, they can be configured to have any shape that provides a substantially straight-line path for insertion of a penis. Also, while the conduits are shown to be nestable via straight-line insertion, they can be reconfigured to interface in other ways, such as by rotating or screwing into each other.

Fifth, although in exemplary versions a conical crown 115 can be used to achieve a suction fit with a vacuum hose, any means of securing the primary conduit 100 to a vacuum hose could be used if desired, such as clips, springs, friction fits, sleeve covering, etc., as long as a sufficient vacuum seal is achieved.

Sixth, although only one coupling end aperture 125 is shown in the figures, one or more apertures of different sizes can be included to vary the obstruction required (by the user plugging the one or more apertures) to maintain suction without breaking the seal of the suction fit.

The invention is not intended to be limited to the preferred versions of the invention described above, but rather is intended to be limited only by the claims set out below. Thus, the invention encompasses all different versions that fall literally or equivalently within the scope of these claims.

What is claimed is:

1. A vacuum-driven personal adapter for male sexual stimulation, a) the adapter including an elongated primary conduit:

1) extending longitudinally from a coupling end to an insertion end, (a) the coupling end having a crown that is tapered such that when the crown is inserted into a vacuum hose of a running vacuum device, the crown is partially sucked into the vacuum hose to secure the conduit to the vacuum hose via a suction fit, (b) the insertion end having a member opening sized to longitudinally receive a penis therethrough;

2) having a coupling end aperture that allows air to flow into the conduit, the coupling end aperture allowing a user to throttle negative pressure within the primary conduit by obstructing the coupling end aperture to varying degrees such that a suction level within the primary conduit varies between:

(a) a minimal suction level when air flow through the coupling end aperture is unobstructed; and (b) a maximum suction level when the coupling end aperture is closed off against air flow therethrough;

3) having a set of primary tuning apertures configured to allow for variation in air flow as different primary tuning apertures are obstructed to different degrees, b) wherein the adapter is configured such that, 1) when the crown is inserted into a vacuum hose and a vacuum is engaged to generate negative pressure in the vacuum hose and thereby secure the primary conduit to the vacuum hose via a suction fit, and 2) when a penis is inserted into the primary conduit that is suction fit with the vacuum hose, 3) air flows into the primary conduit on its way to the vacuum hose to vibrate the penis, c) the adapter further including a secondary conduit sized to fit within the primary conduit to decrease a diameter of the member opening, wherein the secondary conduit includes a set of secondary tuning apertures correspondingly spaced such that, when the secondary conduit is inserted into the primary conduit, at least a majority of secondary tuning apertures are alienable with primary tuning apertures.

2. The adapter of claim 1 wherein the set of primary tuning apertures:

a) are proximate to the member opening at the insertion end; and b) include at least four apertures at least substantially equally spaced from each other circumferentially about the primary conduit.

3. The adapter of claim 1 wherein the primary tuning apertures are configured such that, when the tuning apertures are unobstructed and a penis is inserted into the primary conduit, a majority of air flowing into the primary conduit to vibrate the penis enters through the tuning apertures.

4. The adapter of claim 1 wherein the primary conduit is not securable to a vacuum hose via a friction fit, such that without suction through the vacuum hose, the primary conduit separates from the vacuum hose without resistance therewith due to friction.

5. The adapter of claim 1 wherein the crown is at least substantially conically tapered such that a circular cross-section of the crown complementarily engages a circular cross-section of an at least substantially cylindrical vacuum hose when the crown is sealed with the vacuum hose via a suction fit.

6. The adapter of claim 1 wherein:

a) the primary conduit includes a primary indentation at the member opening; and b) the secondary conduit includes a secondary alignment protrusion sized to be at least partially received in the primary indentation, wherein the primary indentation and secondary alignment protrusion are configured such that, when the secondary conduit is inserted into the primary conduit, the secondary tuning apertures rotationally align with the primary tuning apertures.

7. The adapter of claim 6 wherein the secondary alignment protrusion is further configured to longitudinally align the primary and secondary conduits such that the secondary conduit is restricted from entering the primary conduit beyond a point at which their ends are flush with each other.

8. The adapter of claim 1 further including a tertiary conduit sized to fit within the secondary conduit to further decrease a diameter of the member opening, wherein the tertiary conduit includes a set of tertiary tuning apertures spaced such that, when the tertiary conduit is inserted into the secondary conduit, at least a majority of tertiary tuning apertures are alignable with secondary tuning apertures.

9. The adapter of claim 8 wherein:

a) the primary conduit includes a primary indentation at the member opening of the primary conduit;

b) the secondary conduit includes a secondary alignment protrusion having a pair of secondary prongs separated by a secondary gap, the secondary alignment protrusion being sized to be received in the primary indentation; and c) the tertiary conduit includes a tertiary alignment protrusion having a tertiary prong sized to be received in the secondary gap, wherein the primary indentation, secondary alignment protrusion, and tertiary alignment protrusion are configured such that, 1) when the secondary and tertiary conduits are nested in the primary conduit, 2) the tertiary tuning apertures overlap with the secondary tuning apertures, and the secondary tuning apertures overlap with the primary tuning apertures.

10. A method of using a vacuum-driven personal adapter for male sexual stimulation, a) the adapter including an elongated primary conduit:

1) extending longitudinally from a coupling end to an insertion end, (a) the coupling end having a crown that is tapered such that when the crown is inserted into a vacuum hose of a running vacuum, the crown is partially sucked into the vacuum hose to secure the conduit to the vacuum hose via a suction fit, (b) the insertion end having a member opening sized to longitudinally receive a penis therethrough;

2) having a coupling end aperture that allows air to flow into the conduit, the coupling end aperture allowing a user to throttle negative pressure within the primary conduit by obstructing the coupling end aperture to varying degrees such that a suction level within the primary conduit varies between:

(a) a minimal suction level when air flow through the coupling end aperture is unobstructed; and (b) a maximum suction level when the coupling end aperture is closed off against air flow therethrough;

3) having a set of primary tuning apertures:

(a) circumferentially spaced about the primary conduit, (b) being positioned proximate to the member opening at the insertion end, and (c) configured to allow for variation in air flow as different primary tuning apertures are obstructed to different degrees, b) the adapter further including a secondary conduit sized to fit within the primary conduit to decrease a diameter of the member opening, wherein the secondary conduit includes a set of secondary tuning apertures correspondingly spaced such that, when the secondary conduit is inserted into the primary conduit, at least a majority of secondary tuning apertures are alienable with primary tuning apertures, c) wherein the method includes the steps of:

1) inserting the crown into a vacuum hose and engaging a vacuum device to generate negative pressure in the vacuum hose and thereby secure the primary conduit to the vacuum hose via a suction fit;

2) inserting a penis into the primary conduit that is suction fit with the vacuum hose; and 3. vibrating the penis using air flowing into the primary conduit on its way to the vacuum hose.

11. The method of claim 10 wherein the penis vibrates without thrusting motion of the penis into the primary conduit.

12. The method of claim 10 further including the step of at least partially obstructing the coupling end aperture before inserting the penis into the primary conduit so as to increase the suction level in the primary conduit.

13. The method of claim 12 wherein the coupling end aperture is removably obstructed with a hand.

14. The method of claim 12 further including the step of un-obstructing the coupling end aperture so as to break a vacuum seal between the primary conduit and the vacuum hose to detach the primary conduit from the vacuum hose.

15. The method of claim 10 wherein the method further includes the step of at least partially obstructing one or more of the tuning apertures so as to manipulate air flow through the primary conduit to effect a sensation experienced through the penis.

16. The method of claim 15 further including the step of variably obstructing and un-obstructing different tuning apertures to different degrees to stimulate different portions of the penis.

17. A vacuum-driven personal adapter for male sexual stimulation, a) the adapter including an elongated primary conduit:

1) extending longitudinally from a coupling end to an insertion end, (a) the coupling end having a crown that is tapered such that when the crown is inserted into a vacuum hose of a running vacuum, the crown is partially sucked into the vacuum hose to secure the conduit to the vacuum hose via a suction fit, and (b) the insertion end having a member opening sized to longitudinally receive a penis therethrough; and 2) having a set of primary tuning apertures circumferentially spaced about the primary conduit, the primary tuning apertures allowing for variation in air flow as different of the apertures are obstructed to different degrees;

b) the adapter further including a secondary conduit sized to fit within the primary conduit to decrease a diameter of the member opening, wherein the secondary conduit includes a set of secondary tuning apertures correspondingly spaced such that, when the secondary conduit is inserted into the primary conduit, at least a majority of secondary tuning apertures are alienable with primary tuning apertures;

c) wherein the adapter is configured such that, 1) when the crown is inserted into a vacuum hose and a vacuum is engaged to generate negative pressure in the vacuum hose and thereby secure the primary conduit to the vacuum hose via a suction fit, and a penis is inserted into the primary conduit with a gap between the penis and an inside of the primary conduit, 2) air flows into the primary conduit on its way to the vacuum hose to vibrate the penis, wherein the penis is vibrated without longitudinal motion of the penis in or out of the primary conduit.

18. The adapter of claim 17 wherein the primary conduit further includes a coupling end aperture that allows air to flow into the conduit, the coupling end aperture allowing a user to throttle negative pressure within the primary conduit by obstructing the coupling end aperture to varying degrees such that a suction level within the primary conduit varies between:

a) a minimal suction level when air flow through the coupling end aperture is unobstructed; and b) a maximum suction level when the coupling end aperture is closed off against air flow therethrough.

* * * * *